United States Patent [19]

Ishizuka

[11] Patent Number: 4,495,037

[45] Date of Patent: Jan. 22, 1985

[54] METHOD FOR ELECTROLYTICALLY OBTAINING MAGNESIUM METAL

[76] Inventor: Hiroshi Ishizuka, 19-2, Ebara 6-chome, Shinagawa-ku, Tokyo, Japan

[21] Appl. No.: 545,255

[22] Filed: Oct. 25, 1983

[30] Foreign Application Priority Data

Nov. 19, 1982 [JP] Japan ..... 57-204229

[51] Int. Cl.[3] ..... C25C 3/04

[52] U.S. Cl. ..... 204/70

[58] Field of Search ..... 204/70

[56] References Cited

U.S. PATENT DOCUMENTS

| | | | |
|---|---|---|---|
| 3,396,094 | 8/1968 | Sivilotti et al. | 204/70 |
| 4,058,448 | 11/1977 | Dmitrievich et al. | 204/70 |
| 4,308,116 | 12/1981 | Andreassen et al. | 204/70 |
| 4,334,975 | 6/1982 | Ishizuka | 204/70 |

*Primary Examiner*—Howard S. Williams

*Attorney, Agent, or Firm*—Larson & Taylor

[57] ABSTRACT

A method for electrolytically obtaining magnesium metal from an electrolytic bath comprising $MgCl_2$, said method comprising: preparing an electrolytic bath composed of $MgCl_2$ and additional ingredients, such that the bath as a whole exhibits a density greater by 0.02 to 0.10 $g/cm^3$ than magnesium at circumstantial temperatures employed, and an electrical conductivity of 2.4 $\Omega^{-1}cm^{-1}$, holding said bath in an arrangement which comprises two spaces separate but in communication with each other, conducting an electrolysis of said bath so that a magnesium metal is deposited cathodically and a chlorine gas, anodically, in a first space, transferring the magnesium metal to the second space to a substantial part as carried under the surface of bath, while the chlorine gas is left to a substantial part in the first space, allowing the bath to dwell in said second space for a time enough for the magnesium to collect to a major part at the surface, and recovering the magnesium metal from the surface in the second space.

1 Claim, 1 Drawing Figure

METHOD FOR ELECTROLYTICALLY OBTAINING MAGNESIUM METAL

Figure 1:
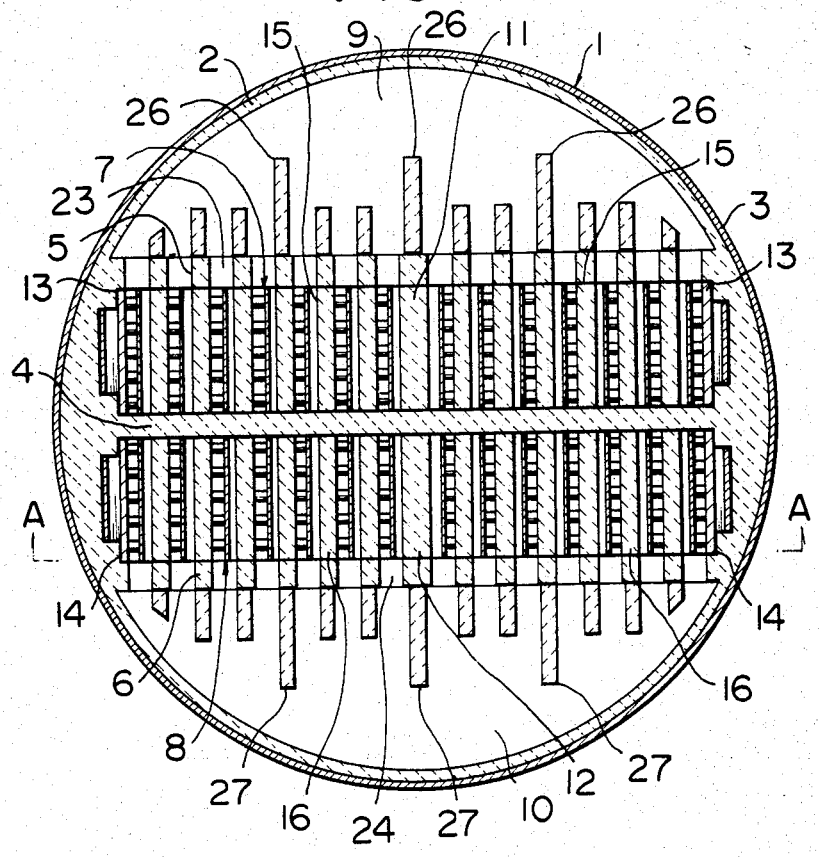

The present invention relates to a method for electrolytically obtaining magnesium metal from an electrolytic bath containing $MgCl_2$ and, in particular, from a bath exhibiting a closer density to magnesium than conventionally, so as to hold magnesium metal product under the surface during transfer from the electrolysis-to collecting chamber for improved yield of the metallic product especially.

Conventionally, magnesium metal is electrolytically produced by depositing from a bath which is composed of a mixture of $MgCl_2$ with NaCl, KCl, LiCl, $CaCl_2$, $CaF_2$ etc., and is recovered by allowing the magnesium to come out to the surface of the bath which exhibits a density greater than the magnesium or, alternatively, by descending the metallic product to the bottom of bath for tapping therefrom.

In the former case, the electrolyte bath is so composed as to exhibit as great a density as possible in comparison with the magnesium product for achieving as good an efficiency as possible for separation from electrode surfaces and collection to the surface of molten magnesium particles, by especially admixing some 30% of $CaCl_2$ which exhibits rather a great specific gravity. For example, Japanese Patent Publication No. Sho 43-9973 (1968) describes a bath composition of $20MgCl_2$- 30NaCl - $30CaCl_2$- 18 KCl - $2CaF_2$, while the composition of $20MgCl_2$ - $30CaCl_2$ - 50NaCl is employed in U.S. Pat. No. 4,334,975.

A greater bath density allows a promoted movement upwards and an efficient collection of molten metal particles. However, it can also cause rather a decreased yield relative to the current input due to more possible combination at the bath surface of once deposited metal with the other product, chlorine, or oxygen from the atmosphere, disadvantageously. Further, the $CaCl_2$ component, while contributing to the lowered melting point of baths, also raises the electrical resistance of bath as whole, due to rather a high electrical resistivity inherent in the material. And elevated tensions thus required for electrolysis with such bath systems result in increased costs in power and construction involved and set unfavorable on applicable currents by increased generation of heat due to the high resistivity of the bath system. Although it is possible to prepare an electrolyte system without $CaCl_2$, such system instead has to contain an increased portion of NaCl in order to provide a proper electrical conductivity and, as a result, calls for rather raised operational temperatures in order to provide a viscosity level of bath low enough to achieve an effective recovery of the metallic product.

Other electrolyte systems δ so far proposed include also, for example, system LiCl-(5–38)$MgCl_2$ described in Japanese Patent Publication No. Sho 36-9055 (1961) and another consists of 5 to approx. 44% to $MgCl_2$, approx. 56% or more of KCl, and a chloride of alkaline earth metal other than magnesium, as described in Japanese Patent Publication No. Sho 36-16701 (1961). Such systems exhibit densities smaller than metallic magnesium to be deposited, and the latter is descended to the bottom of bath and tapped therefrom by means of complicated mechanisms, disadvantageously in this regard to the above described technique whereby the metal is collected at the surface of bath and simply recovered therefrom.

Therefore, one of the principal objects of the present invention is to provide a method for obtaining magnesium metal, eliminated of above said drawbacks in the electrolysis of baths comprising $MgCl_2$.

According to the invention there is provided a method for electrolytically obtaining magnesium metal from such bath, said method comprising: preparing an electrolytic bath composed of $MgCl_2$ and additional ingredients, such that the bath as a whole exhibits a density greater by 0.02 to 0.10 g/cm$^3$ than magnesium at circumstantial temperatures employed, and an electrical conductivity of 2.4 $\Omega^{-1}cm^{-1}$, holding said bath in an arrangement which comprises two spaces separate but in communication with each other, conducting an electrolysis of said bath so that a magnesium metal is deposited cathodically and a chlorine gas, anodically, in a first space, transferring the magnesium metal to the second space to a substantial part as carried under the surface of bath, while the chlorine gas is left to a substantial part in the first space, allowing the bath to dwell in said second space for a time enough for the magnesium to collect to a major part at the surface, and recovering the magnesium metal from the surface in the second space.

The bath systems of the invention optimally are devoid of a $CaCl_2$ component; instead they consist essentially of $MgCl_2$ and NaCl, together with KCl and/or LiCl. The bath systems are so composed as to exhibit, as a whole, a specific gravity or density only slightly greater than magnesium metal coexisting therewith, essentially by 0.02 to 0.10 g/cm$^3$, and at an operational temperature of some 670° C., for example, the bath should adequately exhibit a density of 1.60 to 1.68 g/cm$^3$, approximately, with a little deviation allowed depending on the cell construction and the operational parameters employed. Too great a density difference allows too fast an ascention of metal to reach the bath surface before it gets to the metal collecting chamber, and causes increasing possible recombination or oxidation of product, while too small a difference in density between the bath and metal results in impractical or, sometimes, impossible recovery of magnesium product. Efficient and practical recovery is only possible within the above said range. And with the adequate difference provided between the bath and the metallic product to deposit therein according to the invention, the latter can be readily separated from the other product of chlorine and effectively transferred substantially in suspension in the bath which flows from the electrolysis to the metal collecting chamber through the upper opening which is characteristically arranged under the bath surface in the partition, while the chlorine gas keeps ascending in the electrolysis chamber for recovery.

The bath systems of the invention are also prepared so as to achieve optimal electrical performance by regulating the conductivity to be 2.4 $\Omega^{-1}cm^{-1}$.

Electrolytic cell arrangements of two spaces, that is an electrolysis chamber and a metal collecting chamber, applicable to the invention may vary widely in construction. A few examples are known from U.S.S.R. Inventors Certificate No. 609,778, EP-Al-81850235.3 and Japanese Patent Kokai No. Sho 58-161,788. The first chamber designed for electrolysis of bath contains a pair or pairs of anode and cathode, without- or with one or more externally unwired electrodes therebetween. The metal collecting chamber basically consists of a space arranged separately but in connection with the electrolysis chamber by opening at levels of the bath surface and the bottom of the partition. The chamber anyhow is so arranged as to allow incoming magnesium carried by the bath in circulation to separate therefrom and ascend to the surface by providing an adequate dwelling time.

A stream is formed of electrolytic bath, driven mainly by bubbles of chlorine which are formed electrolytically and ascend in the bath in the electrolysis chamber; the flow may be advantageously promoted by adopting such arrangement, for cooling the bath in the metal collecting chamber, as disclosed in U.S. Pat. No. 4,334,975 and/or such arrangement for more directional intensified flow with a varying gap between adjacent electrodes as shown in the above said European patent application. Anyway, thus provided stream takes the metallic product through the opening in the partition in the metal collecting chamber, where the metal is separated from the bath which keeps descending. The other product, chlorine, is substantially removed from the bath before and when the latter passes the opening under the bath surface into the metal collecting chamber. The stream of bath as thus stripped of products runs back to the electrolysis chamber through another opening provided in a bottom of the partition.

Now the invention will be described move in particular in reference with the attached drawing herewith.

Figure 2:
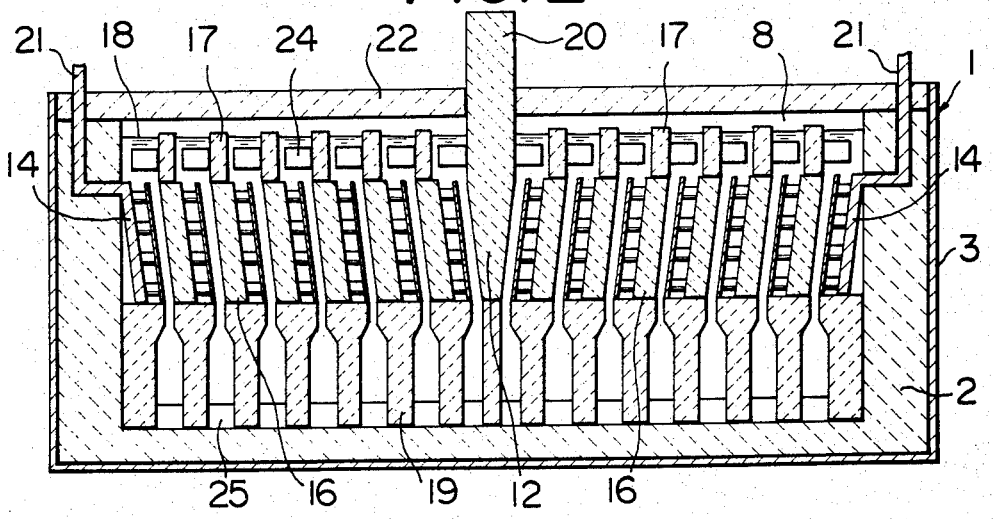

FIG. 1 illustrates a horizontal view in section of an arrangement suitable for practice of the invention, and FIG. 2 illustrates an elevational view in section of such arrangement as taken along A—A on FIG. 1.

In the figures the electrolysis cell, generally designated at 1, comprises a wall structure 2 of such electrical insulative refractory as alumina, which is arranged along a shell 3 of carbon steel of, for example, SS grade according to the Japanese Industrial Standards. The space defined by the wall structure 2 is divided with a central partition 4 of insulative material into halves which, in turn, are divided with side partitions 5, 6 into electrolysis chambers 7, 8 and second chambers 9, 10 for stripping and collecting magnesium metal from the bath. In the electrolysis chambers, respectively, there are an anode body 11, 12 substantially of graphite at a middle and a cathode of iron plate 13, 14 at each end of the length symmetrically relative to the anode, with a row of several intermediate electrodes between the anode and each cathode. Said intermediate electrodes, specifically designated at 15 or 16, may be composed, each, of an iron plate and a graphite slab joined together with iron rods. Provided atop with an insulative block 17, of such height as to reach above the surface level 18 of bath, each of said cathodes and intermediate electrodes as well as the anode is seated on the respective stand, specifically at 19, of refractory bricks of alumina, for example. Terminals 20, 21 protrude upwards from the lid 22 for electrical wiring. There are several holes 23, 24 slightly above the cathodes 13, 14 and intermediate electrodes 15, 16 for a bath loaded with magnesium metal to flow into the metal collecting chamber 9, 10 and some holes 25 at a bottom for the bath as stripped of the metallic product to flow back into the electrolysis chambers 7, 8. There are a series of insulative projections 26, 27 on the side partitions, extending into the metal collecting chambers 9, 10 for suppressing possible stray currents through the bath and the magnesium carried thereby. Such projections, conveniently constructed perpendicular to the partitions, preferably rise from the floor to above the bath surface for optimal suppression achievement. Magnesium metal is collected in the chambers 9, 10 and tapped therefrom for pouring into ingot molds or, alternatively, for transporting in liquid state to adjacent plants where $TiCl_4$ or $ZrCl_4$ is converted to metal.

The wall structure has rather a decreased thickness in comparison with conventional designs, and as air is forcibly blown or water is passed on the shell, heat can be efficiently removable from the bath, so that, in spite of heat generation during electrolytic operations, the bath is kept at reasonable temperatures and, as a result, material damage can be substantially reduced for the wall structure and the electrodes. The cooling can be carried out to such degree that the wall structure is deposited with a solidified layer of electrolyte, which exhibits a substantially decreased electrical conductivity and permits an improved current efficiency by better suppressing current leakage to the shell.

EXAMPLE 1

An electrolytic arrangement basically illustrated in FIGS. 1 and 2 was used, which comprised a wall structure some 20 cm thick of alumina bricks, arranged inside and along a cylindrical shell of SS grade carbon steel. The shell, measuring 7 m in O.D. and 2.5 m in length, approximately, was coolable with water flowing on the surface in the open. A pair of electrolysis chambers measuring inwards 1.2 m by 5 m by 2.2 m (height) were arranged symmetrically relative to the central partition. Each chamber contained an anode body of graphite, which was 2.5 m$\times$1.2 m wide, across at the center, cathodes of iron 1.2 m$\times$0.8 m wide at both ends and, between the anode and each cathode, a row of six intermediate electrodes, each consisting of an iron plate joined to a graphite slab with several bolts of iron implanted at one end in the graphite and welded to the iron at the other. Such arrangement was charged with an electrolytic bath which was composed of 20% of $MgCl_2$, 60% of NaCl and 20% of KCl, by weight, and exhibited a density of 1.63 g/cm$^3$ and an electrical conductivity of 2.53 $\Omega^{-1}cm^{-1}$ at the operational temperature of some 670° C., in comparison with magnesium exhibiting 1.58 g/cm$^3$ and thus a density difference of 0.05 g/cm$^3$ at the temperature. A tension of 30 volts was applied between each pair of anode and cathode contained, thus passing a current of 5000 amperes at a density of 0.52 A/cm$^2$ between the pair. Some 1.4 tons of magnesium metal and 4.1 tons of chlorine gas was yielded as a result of 24 hours' operation. Power consumption was calculated to be 10.29 KWH/Kg-Mg.

EXAMPLE 2

The electrolytic arrangment of Example 1 was used. The electrolytic bath employed was composed of 20% of $MgCl_2$, 60% of NaCl, 10% of KCl and 10% of LiCl, and exhibited at the operational temperature of some 670° C. a density of 1.62 g/cm$^3$, providing a difference of 0.04 g/cm$^3$ and an electrical conductivity of 2.95$\Omega^{-1}cm^{-1}$. A tension of 29.1 volts was applied between each pair of anode and cathode, so as to pass a current of 5000 amperes. As a result of 24 hours' such operation, substantially identical yields were achieved with the metal and gas, at a power consumption of 9.94 KWH/KG-MG.

REFERENCE

The electrolytic arrangement of above described examples was filled for the purpose of comparison with a conventional composed electrolytic bath of 20$MgCl_2$-50NaCl-30$CaCl_2$, of which the density was some 1.78 g/cm$^3$ at 670° C., and operated at parameters identical to those employed in the above examples. The 24 hours' operation yielded 1.35 tons of magnesium and 3.95 tons of chlorine, approximately, with the power consumption achieved of 11.73 KWH/Kg-Mg.

As may have been apparent from the description given above, the present invention permits:

(1) an improved yield of magnesium and chlorine as well, as a result of substantial elimination of oxidation and recombination of once deposited products, since the metallic product is allowed to rest under the surface of bath until it reaches the metal collecting chamber due to the substantially decreased difference in density between the magnesium and bath specially regulated according to the invention;

(2) further improved yields of magnesium and chlorine, respectively, by employing bath surface levels kept well above the upper communication opening between the electrolysis and collecting chambers, because such raised bath levels, now made available due to the substantially decreased difference in density, facilitates transportation of magnesium into the collecting chamber and blocks effectively chlorine gas to be accompanied thereinto;

(3) simplified operation with extended intervals available of charging raw materials, due to such raised bath levels which provide an extended range of applicable bath level; and (4) improved hourly productivity per cell for magnesium and chlorine products, by employing intensified currents which have been now available without increasing possibility of material damage to the cell arrangement, as the electrolyte systems of the invention allow only decrease generation of heat due to high electrical conductivity levels, with such high resistive component as $CaCl_2$ eliminated.

What is claimed is:

1. In a method of electrolytically obtaining magnesium metal from an electrolytic bath which comprises $MgCl_2$, comprising: preparing and holding a fused bath in an arrangement which comprises two separate spaces, depositing magnesium metal cathodically and chlorine gas anodically in the first space, transferring magnesium metal carried by the bath to the second space through a channel means arranged between the spaces, and allowing magnesium metal, for recovery, to collect to a major part at the surface of bath in the second space, the improvement in which said electrolytic bath consists of $MgCl_2$ and NaCl, as well as at least one compound selected from KCl and LiCl but without $CaCl_2$, so composed as to exhibit an electrical conductivity of $2.4\Omega^{-1}cm^{-1}$ and a density greater by 0.02 to 0.10 g/cm$^3$ than magnesium at circumstantial temperatures employed, so the magnesium metal in transfer may be held for the substantial part under the surface until the metal enters the second space and ascend to the surface in time in said space.

* * * * *